US007677989B2

(12) United States Patent
Fletcher

(10) Patent No.: US 7,677,989 B2
(45) Date of Patent: Mar. 16, 2010

(54) GOLF CLUB STAND FOR REMEMBERING CLUBS

(76) Inventor: Johnnie Fletcher, 1525 Northbourne Rd., Baltimore, MD (US) 21239

( * ) Notice: Subject to any disclaimer, the term of this patent is extended or adjusted under 35 U.S.C. 154(b) by 0 days.

(21) Appl. No.: 12/288,446

(22) Filed: Oct. 20, 2008

(65) Prior Publication Data

US 2009/0111601 A1 Apr. 30, 2009

Related U.S. Application Data

(63) Continuation-in-part of application No. 11/586,289, filed on Oct. 25, 2006, now abandoned.

(51) Int. Cl.
*A63B 55/10* (2006.01)

(52) U.S. Cl. ..... 473/282

(58) Field of Classification Search ..... 473/282
See application file for complete search history.

(56) References Cited

U.S. PATENT DOCUMENTS

| | | | | | |
|---|---|---|---|---|---|
| 1,366,872 | A * | 1/1921 | Cantleberry | 248/125.1 |
| 3,076,557 | A * | 2/1963 | Husted et al. | 211/196 |
| 3,584,821 | A * | 6/1971 | Glebe | 248/156 |
| 4,210,334 | A * | 7/1980 | Lind | 473/282 |
| 4,461,220 | A * | 7/1984 | Wetzel | 108/30 |
| 5,285,990 | A * | 2/1994 | Engel | 248/156 |
| 5,597,363 | A * | 1/1997 | Leote | 473/282 |
| 5,884,881 | A * | 3/1999 | Band et al. | 248/166 |
| D422,747 | S * | 4/2000 | Evans | D27/183 |
| 6,514,159 | B2 * | 2/2003 | Hendren | 473/408 |
| 6,645,092 | B1 * | 11/2003 | Hendren | 473/408 |
| 7,153,218 | B1 * | 12/2006 | Elkin | 473/282 |
| 7,318,266 | B2 * | 1/2008 | Bergh | 29/434 |
| 2007/0155528 | A1 * | 7/2007 | Miller | 473/282 |

* cited by examiner

*Primary Examiner*—Stephen L. Blau
(74) *Attorney, Agent, or Firm*—Ober, Kaler, Grimes & Shriver; Royal W. Craig

(57) ABSTRACT

A golf club stand to prevent the forgetting of spare clubs by standing them upright in a noticeable position when they are carried to a shot but are not used. The club stand folds into a compact configuration resembling a golf club for convenient carrying in a gold bag when not in use. The device generally comprises a shaft with a grip-handle similar to that of a golf club, and a sharp point at the distal end of the shaft to allow the club to be inserted into the ground. In addition, a dual-pivot arm is secured to the upper end of the shaft for supporting the handle(s) of one or more golf clubs. The ends of the dual-pivot arm are formed as cradles and may be pivoted into a transverse in-line position relative to the shaft. When the shaft is inserted vertically into the ground and the cradle ends of the pivot arm are horizontally disposed, a plurality of clubs may be supported by the club stand, the head of each club resting on the ground and the handle of all clubs supported by the transverse arm in one of the cradle ends. This keeps the clubs off the ground and highly visible. When they are standing upright in plain view they are harder to overlook and forget.

4 Claims, 2 Drawing Sheets

GOLF CLUB STAND FOR REMEMBERING CLUBS

CROSS-REFERENCE TO RELATED APPLICATION(S)

The present application is a continuation-in-part of U.S. application Ser. No. 11/586,289 filed Oct. 25, 2006 now abandoned.

BACKGROUND OF THE INVENTION

1. Field of the Invention

The present invention relates to golf accessories, and more precisely, to a club stand to prevent the forgetting of spare clubs by standing them upright in a noticeable position when they are brought to a shot but not used.

2. Description of the Background

Golf clubs inevitably maintain well-stocked lost and found services for clubs that have been left behind. This is because it is exceedingly easy to forget clubs while golfing. Due to golf cart restrictions, golfers must typically take a range of different clubs to each shot. They use one of the clubs to execute the shot, but leave the rest lying nearby on the green or in the rough. Since golf clubs lie flat, the clubs provide almost no visual reminder to the golfer to retrieve the spare clubs. This is especially true when the clubs are obscured by thick grass. To execute the immediate shot, it is commonplace for the golfer to put the spare clubs out of his/her mind. The shot is typically followed by some measure of excitement or disappointment, and the golfer inevitably forgets the spare clubs completely. They move on to the next hole, and the clubs either wind up in the lost and found, or lost forever. Indeed, most all golfers have experienced the frustration of leaving a club on the previous green or fairway. What is needed to prevent this is a device to provide better visual cues after the shot, thereby providing a reminder and avoiding lost clubs. It would be greatly advantageous to provide a device that keeps the clubs off the ground, more visible and, consequently, harder to overlook because they are standing upright in plain view.

SUMMARY OF THE INVENTION

It is, therefore, an object of the present invention to provide a gold club stand for maintaining spare clubs in one place, erect and easily accessible, thereby helping to avoid lost clubs.

It is another object to provide a golf club stand for spare clubs that provides better visual cue after a shot, thereby avoiding lost clubs.

It is still another object to provide a golf club stand for spare clubs that is easily manipulated, and which has a profile similar to a golf club so that it can be stored like a club in the golfer's bag.

According to the present invention, the above-described and other objects are accomplished by providing a club stand to prevent the forgetting of spare clubs by standing them upright in a noticeable position when they are carried to a shot but are not used. Importantly, the club stand folds into a compact configuration resembling a golf club for convenient carrying in a gold bag when not in use. The device generally comprises a shaft with a grip-handle similar to that of a golf club, and a sharp point at the distal end of the shaft to allow the club to be inserted into the ground. In addition, a dual-pivot arm is secured to the upper end of the shaft for supporting the handle(s) of one or more golf clubs. The ends of the dual-pivot arm are formed as cradles and may be pivoted into a transverse in-line position relative to the shaft. When the shaft is inserted vertically into the ground and the cradle ends of the pivot arm are horizontally disposed, a plurality of clubs may be supported by the club stand, the head of each club resting on the ground and the handle of all clubs supported by the transverse arm in one of the cradle ends. This keeps the clubs off the ground and highly visible. When they are standing upright in plain view they are harder to overlook and forget. The club stand is very easy to use and collapses for easy carrying in any golf bag.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENT

The present invention is a club stand to prevent the forgetting of spare clubs by standing them upright in a noticeable position when they are brought to a shot but not used.

Figure 1:
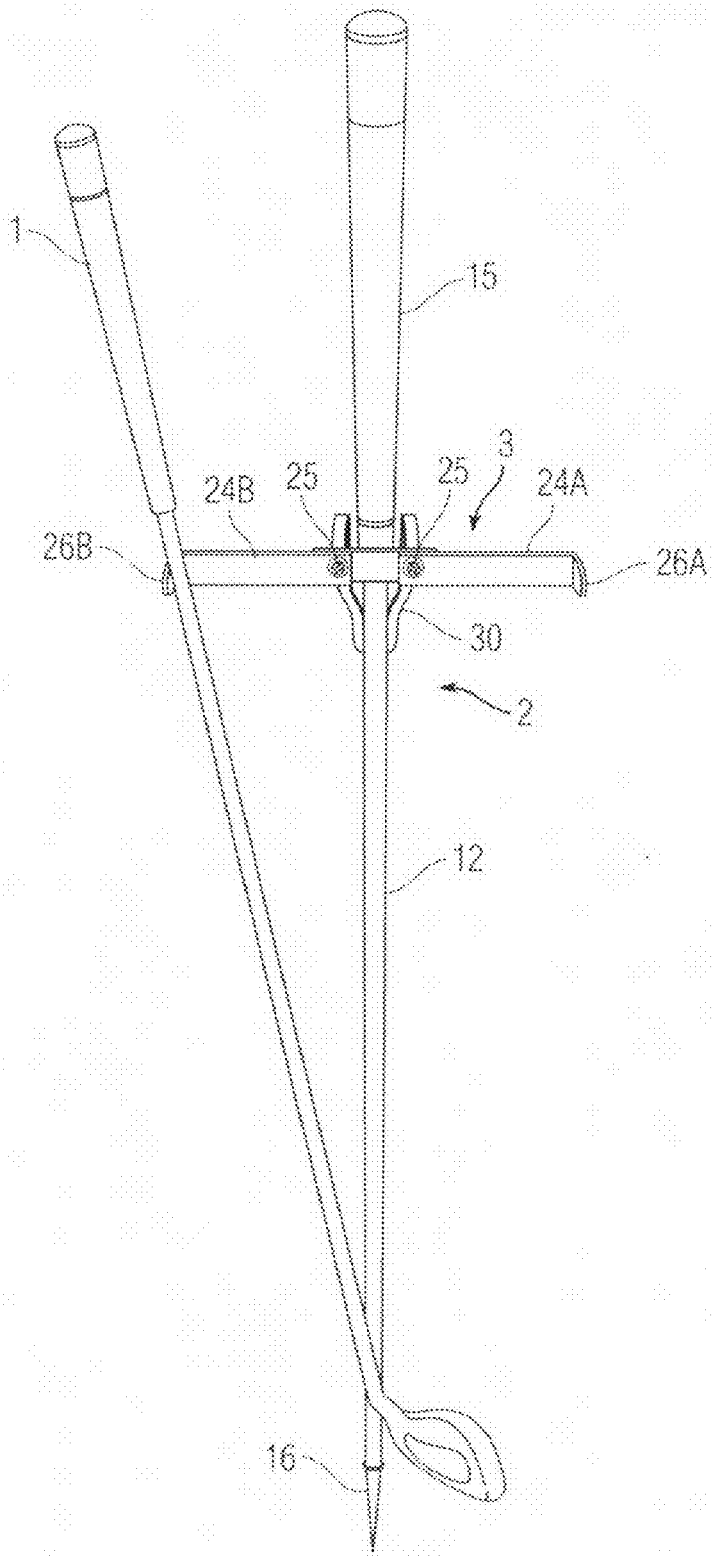
FIG. 1 is a perspective view of a club stand 2 to encourage remembering of spare clubs 1 according to a preferred embodiment of the present invention (illustrating how a conventional golf club 1 is supported).

FIG. 1 shows the club stand 2 of the present invention and illustrates how one conventional golf club 1 is supported, albeit any number may be so supported as needed.

The club stand 2 comprises an elongate tapered hollow shaft 12 such as a conventional golf club shaft formed of tubular aluminum, graphite or wood stock. The larger upper end of the shaft 12 is fitted with a conventional golf club golf grip 15. The shaft 12 extends downwardly to a ground-insertion spike 16 preferably defined by a dull rounded point at the distal end to facilitate insertion of the shaft 12 into the ground in an upright position. The spike 16 may be a plastic ground spike that is friction fit into the narrow lower end if the hollow shaft 12. A dual-pivoting support arm 3 is attached to the neck of the shaft 12 just below the grip 15, the support arm 3 being equipped with cradle ends to retain the clubs. The cradle ends of the support arm 3 pivot from a substantially vertical position (parallel and flush with shaft 15) to horizontal (transverse to shaft 15). When support arm 3 is in the flush position, the club stand 2 can be easily stowed and carried in the manner of all other clubs in the golfer's bag. When support arm 3 is in the transverse position, it supports as many clubs 1 as desired in a standing position, the head of each club 1 resting on the ground and the handle of the clubs 1 being cradled in the support arm 3.

Figure 2:
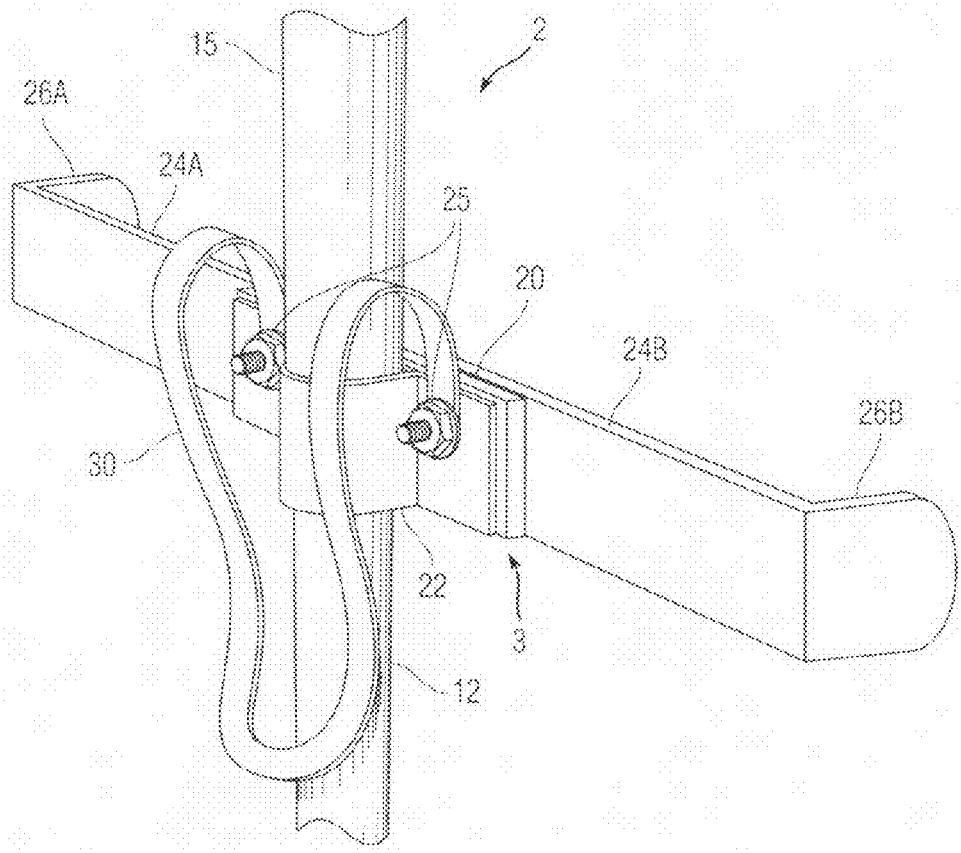
FIG. 2 is an enlarged perspective view of the dual-pivoting support arm used in the device of FIG. 1.

FIG. 2 is an enlarged perspective view of the dual-pivoting support arm 3 attached to the neck of the shaft 12 just below the grip 15. The dual-pivoting support arm 3 further comprises a transverse strut 20 formed as a flat 1-2" member fixedly attached to the shaft 12 by a yoke member 22 that encircles the shaft 12 and is screwed to the transverse strut 20 on opposing sides of the shaft 12. The yoke member 22 and transverse strut 20 form a compression fitting with shaft 12 to maintain the transverse strut 20 in a fixed and substantially horizontal position. The transverse strut 20 protrudes slightly outward on opposing sides of the shaft 12 to distal ends defined by through bores. A pair of cradle brackets 24A and 24B are pivotally attached by compression screws 25 to the through bores of the transverse strut 20. Each cradle bracket 24A and 24B comprises a flat elongate member pivotally attached at one end to a corresponding end of the transverse strut 20, end extending to an orthogonally-oriented flange 26A, 26B. The flanges 26A, 26B may be formed by bending the ends of cradle brackets 24A and 24B inward perpendicularly as shown, or alternatively into inwardly furled hooks.

In operation, each of the cradle brackets 24A and 24B is independently moveable from a first position inline with the transverse strut 20 to a second position substantially inline, and flush with the shaft 12.

When support arm 3 is in the fully flush position, the club stand 2 can be easily stowed and carried in the manner of all other clubs in the golfer's bag. When support arm 3 is in the transverse position, it supports as many clubs 1 as desired in a standing position, the head of each club 1 resting on the ground and the handle of the clubs 1 being cradled in the support arm 3.

Preferably, a bag clip 30 is attached as shown. The bag clip 30 is formed as a resilient curvilinear member affixed at the compression screws 25 and arching up, then down on each side of the shaft 12, joined at a lip that is slightly elevated outward from the shaft 12. The upper ends of bag clip 30 may likewise be secured by compression screws 25 in a sandwiched configuration with cradle brackets 24A, 24B and transverse strut 20. The bag clip 30 is designed for slidable insertion over the rim of standard golf bags to affix the club stand 2 in position adjacent the side of the bag. This adds to the convenience of the club stand 2.

In use, club stand 2, 10 is carried in the golfer's bag in the same manner as all other clubs 1. Whenever the golfer must take a variety of different clubs to a shot, they also remove the club stand 2 and take it with them. When they use one of the clubs 1 to execute the shot, rather than leaving the other clubs 1 lying nearby on the green or in the rough, they are propped upright on the club stand 2. The club stand 2 is spiked into the ground so that it remains upright, and the support arm 3 is pivoted into the transverse position, and the spare clubs 1 are propped against it upright. Since now the golf clubs 1 are upright in plain view, they provide an unmistakable visual reminder to the golfer to retrieve the spare clubs 1.

As many clubs 1 as desired may be supported by the club stand 2. Once attached, the club stand 2 maintains the club(s) 1 in one place, erect and easily accessible, and it allows single-handed carrying and repositioning of the club stand 2 and clubs 1 together simply by gripping the handle, pulling and reinserting.

Having now fully set forth the preferred embodiment and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

I claim:

1. A golf club stand, comprising:

an elongate shaft having a top end and a distal end having a ground-insertion spike;

a golf club grip adhered applied to said top end of said elongate shaft; and a dual-pivoting support arm secured to said shaft beneath said golf club grip for supporting one or more golf clubs in a substantially upright position when said ground-insertion spike is inserted into the ground, said support arm further comprising, a transverse strut fixedly attached to said shaft beneath said golf club grip and extending to opposed ends, and a pair of cradle brackets each comprising an elongate member pivotally attached at one end to a corresponding end of said transverse strut, and the other end extending to an orthogonally-oriented flange, each of said cradle brackets being moveable from a first position inline with said transverse strut to a second position substantially inline with said shaft.

2. A golf club stand according to claim 1 wherein said ground-insertion spike comprises a dull point.

3. A golf club stand according to claim 1, further comprising a bag clip attached to said transverse strut for securement to a golf bag.

4. A golf club stand according to claim 1, wherein said elongate shaft is aluminum, graphite, or wood.

* * * * *